United States Patent [19]

Shank et al.

[11] Patent Number: 4,789,026

[45] Date of Patent: Dec. 6, 1988

[54] POLISHED SURFACE CAPILLARY GROOVES

[75] Inventors: Brian E. Shank, Rothsville; Robert M. Shaubach, Lititz, both of Pa.

[73] Assignee: Thermacore, Inc., Lancaster, Pa.

[21] Appl. No.: 66,562

[22] Filed: Jun. 26, 1987

[51] Int. Cl.[4] ..... F28D 15/02

[52] U.S. Cl. ..... 165/104.26; 165/133; 122/366

[58] Field of Search ..... 165/104.26, 133; 122/366

[56] References Cited

U.S. PATENT DOCUMENTS 3,528,494 9/1970 Levedahl .
3,786,861 1/1974 Eggers ..... 165/104.26
3,892,273 7/1975 Nelson .
4,116,266 9/1978 Sawata et al. .
4,322,739 3/1982 Sliwa, Jr. .
4,457,059 7/1984 Alario et al. .
4,489,777 12/1984 Del Bagno et al. .

*Primary Examiner*—Albert W. Davis, Jr.
*Attorney, Agent, or Firm*—Martin Fruitman

[57] ABSTRACT

Capillary grooves in a heat pipe which are specifically constructed to suppress boiling. Conventionally shaped grooves are constructed with highly polished surfaces. The high polish discourages vapor bubbles which otherwise interfere with the liqud transport function of the arteries. A method of constructing the highly polished grooves by vapor deposition onto matching mandrels is also disclosed.

4 Claims, 3 Drawing Sheets

POLISHED SURFACE CAPILLARY GROOVES

SUMMARY OF THE INVENTION

The United States Government has rights to this invention pursuant to Contract No. F33657-86-C-2137 between the United States Air Force and United Technologies Corporation.

This invention deals generally with heat pipes and more specifically with the structure and construction of capillary grooves within heat pipes.

It is generally understood in the art of heat pipes that the heat flux handling capability of grooved wick heat pipes is limited by two factors. One is the capillary capability of the structure, that is, the ability of the grooves to transport liquid to the evaporator. The second limitation, the one addressed by this invention, is the tendency for local boiling to occur at the evaporator.

When such boiling occurs, vapor bubbles created at the boiling sites tend to block the liquid flow in the grooves, preventing the supply of liquid to the evaporator and causing the evaporator to dry out. This limits the heat flux handling capability of the heat pipe to less than that which would be expected from the capillary structure of the grooves.

The preferred embodiment of the present invention achieves a dramatic reduction in the tendency of heat pipe capillary grooves to boil by furnishing a structure which has highly polished surfaces within the grooves. While typical machined grooves have a surface roughness measure of 32 microinches R.M.S. and typical extruded grooves have a surface roughness measure of 16 microinches R.M.S., the surfaces of grooves in the preferred embodiment of the invention have a roughness measure of 2 to 8 microinches R.M.S. This increase in smoothness results in a dramatic increase in resistance to boiling within the grooves.

For instance, in a heat pipe with polished grooves and with lithium as the working fluid the temperature required to initiate boiling at a particular site can increase as much as 400 degrees C. The structure of the invention therefore furnishes a heat pipe with greatly increased heat flux capability.

The present invention also includes a method of producing the structure economically and with consistently good results. This is accomplished by forming the grooved wicks on a mandrel which is itself highly polished, thereby resulting in a highly polished surface on the grooves which result from contact with the mandrel.

The mandrel is constructed by assembling alternating laminations of differing size into a structure which has one or more grooved surfaces, but before assembly, the laminations are polished. The grooves which result when the mandrel is assembled are therefore also uniformly polished. The polishing of the interior of such narrow grooves, typically 0.005 to 0.010 inches wide, would otherwise be almost impossible to accomplish if the mandrel was first completely assembled.

For the preferred embodiment the actual construction is also done in a unique manner. With the mandrel fully assembled, a metal layer is deposited on the edges of the laminations by chemical vapor deposition. The procedure not only creates a surface with superior smoothness, but it also creates a part of very high purity.

An alternate embodiment of the invention has one more feature which is practical to a large extent only because of the laminated mandrel construction. The alternate embodiment is one in which the operating capillary structure has polished surfaces only within the grooves, and the lands, the surfaces between the grooves, are unpolished or even roughened. It is desirable for the land to be rough, rather than smooth, so that the area of the land is supplied with a wicking surface that transports liquid for evaporation. This increases the actual quantity of evaporative surface available and thus reduces the local heat flux and resulting temperature drop.

With part of the mandrel itself constructed with a rough surface, the metal deposited upon that surface takes on a similar roughness. Therefore, the resulting structure can be made to have alternating rough and polished surfaces merely by alternating laminations with differing surface finish on their ends as they are assembled into the complete mandrel.

The invention therefore furnishes a most desirable capillary wick structure, one in which boiling is prevented within the grooves where it will impede the function of the heat pipe, but one in which evaporation is promoted on the lands between the grooves in order to fulfill the intended purpose of the heat pipe.

DETAILED DESCRIPTION OF THE INVENTION

Figure 1:
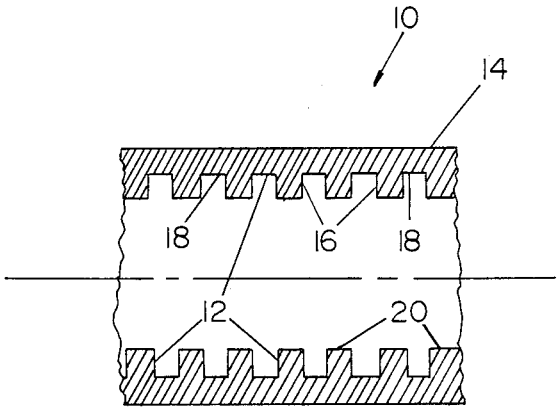
FIG. 1 is a partial cross section view of a groove structure constructed according to the preferred embodiment of the invention.

FIG. 1 is a cross section of a small axial section of cylindrical heat pipe 10 in which circumferential grooves 12 are located on the inside surface of heat pipe casing 14. The particular characteristic that distinguishes this invention from prior art grooved heat pipes is that all the surfaces of the interior of casing 14 are highly polished, typically to a roughness measure of 4 to 8 microinches R.M.S.

Thus, groove sides 16, groove valleys 18 and land 20 are all highly polished. This structure is most desirable when it is important to prevent boiling anywhere in the region of the grooves.

Figure 2:
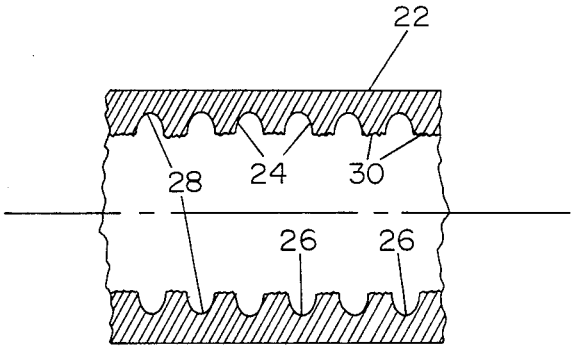
FIG. 2 is a partial cross section of an alternate embodiment of the invention.

FIG. 2 is a similar cross section of a small axial section of cylindrical heat pipe evaporator 22 which depicts an alternate embodiment of the invention which includes additional features to enhance the operational capabilities of heat pipe evaporator 22.

In heat pipe evaporator 22, side walls 24 of and valleys 26 of grooves 28 are similar to those in heat pipe 10 of FIG. 1 in that they are highly polished, but lands 30 between grooves 28 are actually rough. This permits heat pipe evaporator 22 to operate under optimum conditions in that polished grooves 28 are highly resistant to boiling within them while rough lands 30, with roughness of greater than 8 microinches R.M.S., encourage evaporation of liquid.

An additional feature of grooves 28 in heat pipe evaporator 22 is that they have rounded valleys 26 with no inside corners. This feature also aids in discouraging boiling of liquid in the grooves, since it eliminates discontinuities at which boiling tends to begin.

Figure 3:
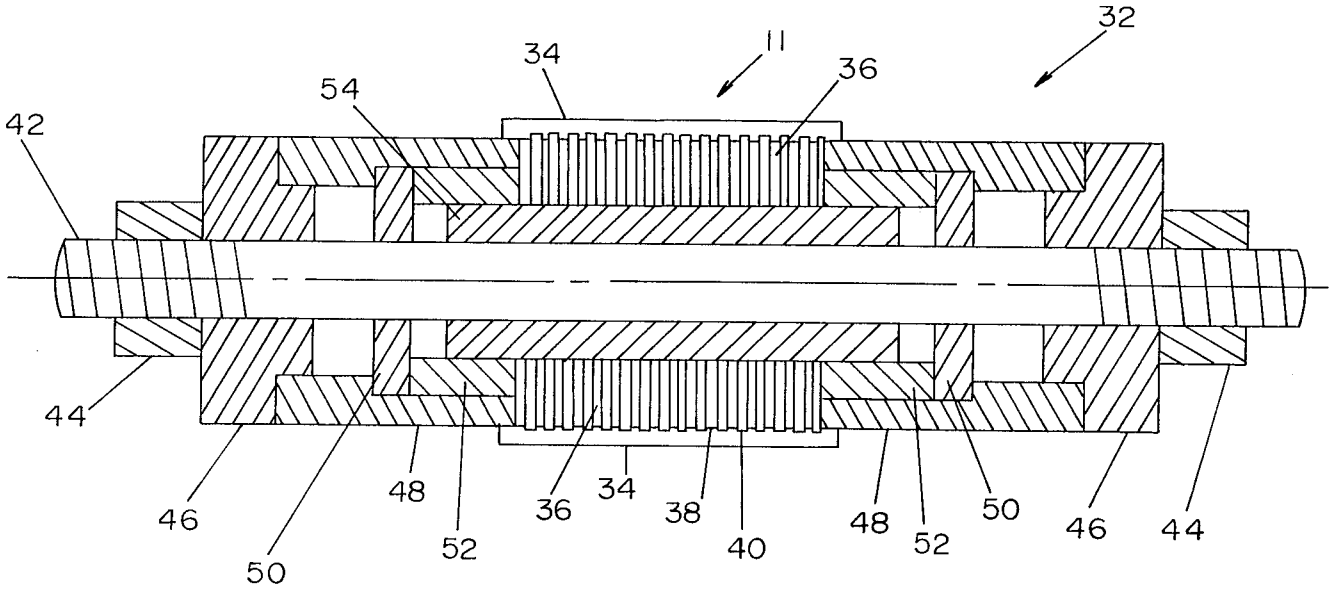
FIG. 3 is an embodiment of a mandrel upon which the preferred embodiment is constructed.

The rounded valleys, along with all the other features of evaporator 22, can be constructed by the use of mandrel 32 shown in FIG. 3 which is of essentially cylindrical configuration and is shown in a cross section parallel to its axis.

In FIG. 3 mandrel 32 is shown with heat pipe 11 already formed upon it. This is accomplished by depositing metal layer 34 upon washer stack 36 by conventional methods such as a chemical vapor deposition or electroplating. Metal layer 34 thus formed is a mirror image of the edge configuration of washer stack 36 which is composed of alternate laminations of washers of two diameters. The difference in diameters between small washer 38 and large washer 40 is exactly twice the depth of the individual grooves which results from the process.

The assembly of mandrel 32 is based upon axial compression force created by center stud 42 and end nuts 44. Nuts 44 hold end caps 46 which, in turn, hold outer pressure cylinders 48 which compress washer stack 36. Outer pressure cylinders 48 also act upon mid-plates 50 which also press inner pressure cylinders 52 against washer stack 36. Core 54, through which center stud 42 passes, centers washer stack 36 so that its washers are properly aligned to form the resulting grooves.

It should be noted that the special features of heat pipe evaporator 22 of FIG. 2 can be attained merely by changing the characteristics of the washers in washer stack 36. For instance, when small washers 38 are given rough outer circumferences, then lands 30 (FIG. 2) are produced with rough surfaces. Also when the outer circumferences of large washers 40 are made to have rounded edges, or even if only their corners are rounded, then valleys 26 (F)G. 2) are produced as rounded. Of course, smooth valleys 26 and smooth side walls 24 of FIG. 2 are produced by polishing the portions of large washers 40 which protrude beyond the circumference of small washers 38 and are therefore in contact with deposited metal layer 34.

It is also important to note that, with available conventional techniques, metal layer 34 can be laid down with sufficient thickness so that, after disassembly of mandrel 32, it is still rigid and self supporting.

The disassembly of mandrel 32 however, requires a special technique. Although removal of end nuts 44 permits all the other mandrel parts to be removed, washer stack 36 remains captured by metal layer 34.

The washers can, however, be removed by destroying them. The preferred process to accomplish this is etching the washers away by using acid. However, other methods are also available. For instance, depending upon the materials used for washer stack 36, it would also be practical to melt washer stack 36 or to burn it away in an oven. In either case, once washer stack 36 is removed, metal layer 34, which is the embodiment shown in FIG. 1 or FIG. 2 is what remains.

The total process by which polished grooves for heat pipes are constructed is best described as follows.

A. Selecting two sizes of flat washers with the same inside diameter, the larger washer with an outside diameter the same as the inside diameter of the heat pipe casing desired and the smaller washer with an outside diameter differing from the outside diameter of the larger washer by two times the depth of the grooves desired;

B. Polishing the portion of the flat sides of the larger washers which extend beyond the circumference of the smaller washer to a roughness measure of no greater than 8 microinches R.M.S.;

C. Polishing the outside circumferences of the larger washers to a roughness measure of no greater than 8 mircoinches R.M.S.;

D. Assembling the washers on a central core which holds them on a single axis with larger washers and smaller washers alternating;

E. Clamping the assembled washers tightly together;

F. Forming a layer of a material of which the grooves are to be constructed on the outside circumferences of the assembled washers;

G. Removing the clamp; and

H. Removing the washers from inside the layer of material formed on their outside circumference.

The addition of rounded valleys is accomplished simply by shaping the outside circumferences of the larger washers to have rounded corners before polishing them. Also the addition of rough lands between the finished grooves is attained merely by roughening the outside circumferencial edges of the smaller washers before assembling the washers onto the central core.

Figure 4:
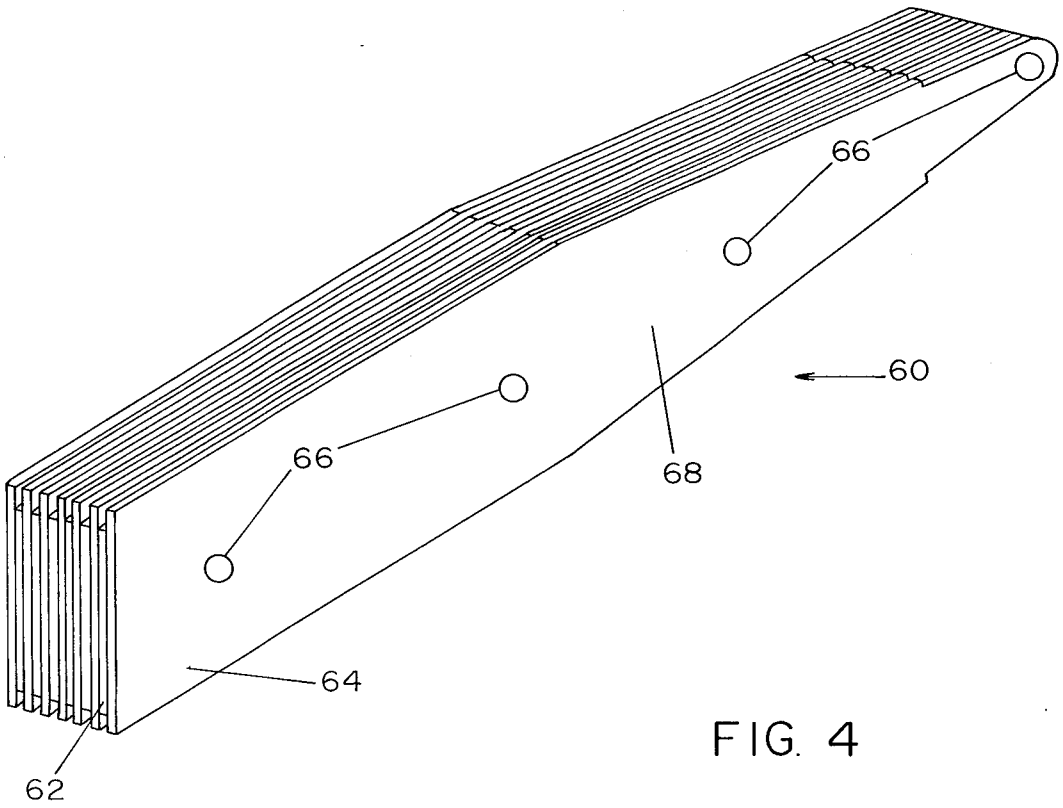
FIG. 4 is a perspective view of an alternate embodiment of a mandrel of a linear configuration of heat pipe grooves.

FIG. 4 depicts, in a perspective view, a mandrel which can be used to produce a heat pipe with grooves in an essentially linear configuration. There, mandrel 60 is assembled of alternating narrower laminations 62 and wider laminations 64 in much the same manner as the mandrel in FIG. 3, except all the laminations also decrease in width as they progress from one end to the other of mandrel 60. Therefore, mandrel 60 can be simply withdrawn from the deposited metal layer (not shown) after the process of formation is complete. Flush through pins 66 are used to hold assembled mandrel 60 together in a manner which permits the grooved portions to be joined by smooth structural layers on sides 68 of mandrel 60.

The method involved in the use of linear mandrel 60 is somewhat simpler than the method of using a cylindrical mandrel. It is as follows.

A. Assembling a mandrel of flat laminations which decrease in width from one end to the other, with smaller laminations of a width equal to the inside dimension of the desired heat pipe alternating with larger laminations which are larger in width than the smaller laminations by the sum total of the depths of facing grooves in a desired heat pipe, the larger laminations being polished to a roughness measure of no more than 8 microinches R.M.S. over their edges and over the portion of their flat surfaces which extend beyond the widths of the smaller laminations;

B. Forming layers of material of which the grooves are to be constructed on the outside of the surfaces formed by the edges of the laminations;

C. Structurally jointing the layers together; and

D. Removing the mandrel from inside the formed groove structure.

Of course, as in the cylindrical mandrel, the edges of the wider laminations can be rounded and the edges of the smaller laminations can be roughened to produce the desirable results afforded by those changes.

It is therefore clear that the method of the invention can be used to produce both circumferential grooves and linear grooves in heat pipes, and in both instances the result is a groove structure which is highly resistant to boiling.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

What is claimed as new and for which Letters Patent of the United States are desired to be secured is:

1. An improved heat pipe comprising a heat pipe casing with grooves formed in the inside surface of the heat pipe casing wherein the surfaces in the grooves have roughness measure of no more than 8 microinches R.M.S.

2. The improved heat pipe of claim 1 wherein the junctions between the surfaces of the grooves are rounded.

3. The improved heat pipe of claim 1 wherein lands between the grooves have a roughness measure of no more than 8 microinches R.M.S.

4. The improved heat pipe of claim 1 wherein lands between the grooves have a roughness measure of greater than 8 microinches R.M.S.

* * * * *